United States Patent [19]

Dahnert et al.

[11] Patent Number: 4,975,804

[45] Date of Patent: Dec. 4, 1990

[54] ELECTRICAL CONTROL MODULE FOR MOBILE STORAGE APPARATUS

[75] Inventors: Dean L. Dahnert, Fort Atkinson; Marvin L. Runge, Edgerton, both of Wis.

[73] Assignee: Spacesaver Corporation, Fort Atkinson, Wis.

[21] Appl. No.: 484,259

[22] Filed: Feb. 26, 1990

[51] Int. Cl.[5] ..... H02B 1/04

[52] U.S. Cl. ..... 361/391; 312/201; 361/336

[58] Field of Search ..... 361/336, 337, 334, 338, 361/339, 342, 346, 390, 391, 393, 395, 396, 399, 331, 394; 52/28, 29, 33, 64, 67, 72, 173 R, 234; D6/438, 439, 476; 312/201, 204; 307/150

[56] References Cited

U.S. PATENT DOCUMENTS

| | | | |
|---|---|---|---|
| 3,708,618 | 1/1973 | Hofmeister et al. | 361/390 |
| 3,921,345 | 11/1975 | Damico | 52/173 R |
| 4,354,330 | 10/1982 | Schwartz | 52/28 |
| 4,437,711 | 3/1984 | Dahnert | 312/198 |
| 4,743,078 | 5/1988 | Dahnert . | |

*Primary Examiner*—Gerald P. Tolin
*Assistant Examiner*—M. W. Phillips
*Attorney, Agent, or Firm*—Fuller, Ryan & Hohenfeldt

[57] ABSTRACT

An electrical control module has electrical components on a circuit board inside of a box which is open on a side opposite of its bottom. A molding section is mounted to one side wall of the box. This molding has the same cross-sectional configuration as a molding which is installed on the edge of the side wall of a mobile storage unit. The side wall molding has a gap in it. The end wall of the storage unit is composed of two parallel upstanding panel members which are spaced apart from each other. The molding extends up to the gap from below and down to the gap from above. The control module slides into the gap and into the space between the panels. The section of molding on the module becomes flush with the molding on the storage unit when the module is inserted in the gap. Means are provided for releasably locking the module in the end wall of the storage unit.

7 Claims, 2 Drawing Sheets

ELECTRICAL CONTROL MODULE FOR MOBILE STORAGE APPARATUS

BACKGROUND OF THE INVENTION

The invention disclosed herein relates to the construction of an electrical control module and a procedure for mounting the module in a mobile storage unit.

Movable storage systems comprise a series of storage units which have shelves or bins, for example, and are movable on tracks to create an access aisle between two of the units and to establish the others in close side-by-side relationship to minimize the amount of floor space required for the units. Usually several mobile storage units are arranged to be movable between stationary storage units. Typically, the mobile units are supported on carriages which have wheels. There is a reversible electric motor mounted on each mobile carriage. The motor is mechanically coupled to the axle for a pair of the wheels for driving the storage units bidirectionally on the tracks. Typically, there are push buttons mounted on the upright end walls of each mobile storage unit. When a person desires to open an aisle between a particular pair of storage units, the person will press a push button which is mounted on an end wall of the storage unit adjacent the aisle which is to be opened. An electrical control module responds to a signal produced by the push button by energizing the motors which will drive the carriages of the storage units in the proper directions for opening of an aisle.

Customarily, the electric control modules were mounted in the mobile storage units in a place which made them difficult to access for inspection, maintenance or replacement. These conditions not only increased the amount of time required for performing maintenance operations due to disassembly of parts of the unit but also created uncomfortable working conditions for the maintenance technician.

SUMMARY OF THE INVENTION

An objective of the invention is to overcome the foregoing disadvantages by providing an electrical control module which is in the nature of box or drawer that is adapted for being inserted into a space between the upright end wall structure of the storage unit and a decorative outer panel. A decorative molding typically covers the space between the panel and the end wall structure of a storage unit. In accordance with the invention, a gap is provided in the vertically extending molding at the time the storage unit is constructed. The box comprising the control module is dimensioned to fit through this gap between the decorative panel and the end wall of the storage unit. A piece of the decorative molding equal in length to the height of the gap is fastened to the box comprising the module. When the control module box is inserted through the gap, the section of the molding on the box enters the gap and is stopped when it is flush with the edges of the gap, that is, when it is flush with the stationary molding which exists above and below the gap.

The invention also features locking means for locking the control module in place. When withdrawal of the box is desired, it is only necessary to turn two screws to unlock it. The screws look like other screws which fasten the molding to the end wall of the units so they are not conspicuous per se. All of the electrical components of the module are mounted on a circuit board which is supported on the bottom of the box. Stops are provided which prevent the control module box from being completely withdrawn from the gap in the molding unless appropriate measures are taken to make this possible. Incoming and outgoing electrical connections to the module are made with cables which have plugs on them for attaching to connectors that are fixed on the circuit board so the circuit board can be disconnected. Thus, if a component on a circuit board fails, the cables are unplugged and the box is completely withdrawn and replaced by a spare box and circuit board assembly so down time is minimized. The control module is mounted at a height above the floor which is convenient for a technician of average height to work on it comfortably.

How the foregoing and other objectives and features of the invention are achieved will be evident in the detailed description of a preferred embodiment of the invention which will now be set forth in reference to the drawings.

DESCRIPTION OF A PREFERRED EMBODIMENT

Figure 1:
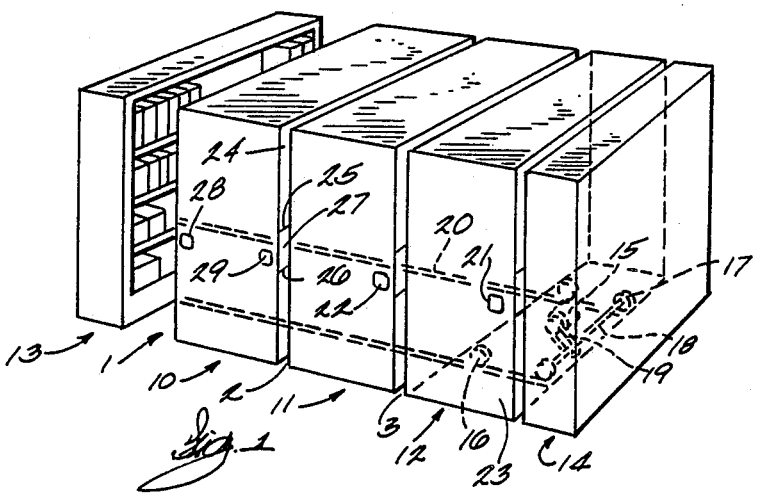
FIG. 1 is a diagram of a plurality of movable storage units wherein three of the movable units are presently in contact with each other and there is an aisle formed between the movable units and a stationary storage unit.

FIG. 1 is a front elevational diagram of a storage unit installation including three power driven movable units 10, 11 and 12 and two stationary storage units 13 and 14. As is well known, the storage units are commonly used to store hardware, files and books, for example, where floor space for the installation can be minimized because it is only necessary to have one open aisle between any adjacent pair of storage units. Units 10–12 are presently parked and are closely adjacent each other such that no usable aisle space exists between them. Aisle 1, existing between stationary storage unit 13 and movable storage unit 10 is fully open to provide access to one side of each of these storage units. The mobile storage units each have a drive motor mounted on it such as motor 15 on typical storage unit 2. Each mobile storage unit is mounted on a frame or carriage, not shown. A typical carriage is shown in U.S. Pat. No. 4,743,078 whose disclosure is incorporated by reference. The carriages have pairs of wheels 16 and 17 and there is an axle 18 on which wheels 17 are mounted. A closed loop chain 19 transmits driving power from motor 15 to axle 18. Since motor 15 is reversible, the mobile units can be driven in either direction along the floor mounted tracks 20 on which the wheels of the storage units run.

Each of the mobile storage units has mounted in an upright decorative end panel member 23 push button assembly such as the one marked 21 on unit 12 and the one marked 22 on unit 11 in FIG. 1. By way of illustration, if the user desires to open aisle 3 between units 11 and 12, push button 22 is operated to activate the motors 15 which results in the movable units moving in the proper direction to create the aisle. One type of electrical system for bringing about these functions is illustrated in cited U.S. Pat. No. 4,743,078 which is owned by the assignee of the present application. Mobile storage unit 10 has two push button assemblies 28 and 29. Operating push buttons 28 opens aisle 1 and operating push button 29 opens aisle 2.

Referring to FIG. 1, each of the storage units has one upright decorative end panels such as the one marked 23 on mobile storage unit 10. The end panels of the units are trimmed or decorated with an aesthetically pleasing molding which faces toward adjacent units and is generally designated by the numeral 24 and is fixed to the storage unit. There is a gap in the molding 24 which is bounded by two edges 25 and 26. The gap is presently occupied by the new drawer type electrical control module which is generally designated by the reference numeral 27.

Figure 2:
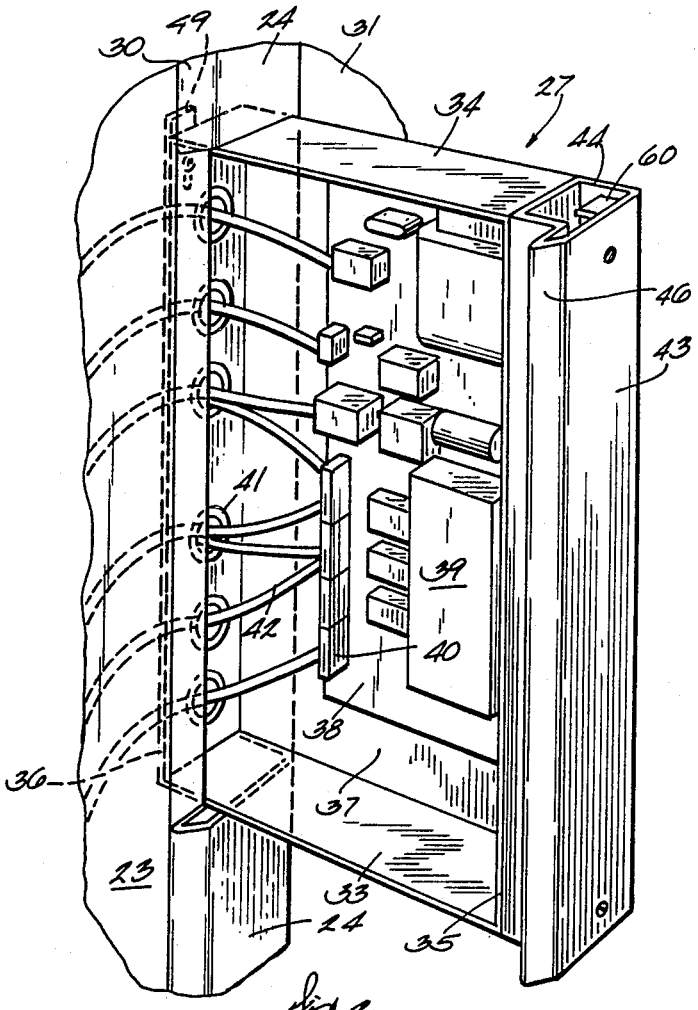
FIG. 2 is a perspective view of the new storage unit electrical control module in the position it attains when it is withdrawn from between the panels which form the end wall of a storage unit for the purpose of performing maintenance, inspection or replacement of the module, for example.

FIG. 2 presents an overall view of the drawer type control module 27. It provides a support for electrical circuitry and includes what is nominally an open topped box comprised of end walls 33 and 34, side walls 35 and 36 and a bottom 37. The term "box" is used herein as generic to any member which has a bottom but does not necessarily have four complete end and side walls. There is a circuit board 38 supported on the bottom of the box. A plurality of electrical components are mounted on the board such as a microprocessor 39 and a plurality of multiple contact connectors such as the one marked 40. End wall 36 of the box 27 is provided with several openings that are occupied by insulating bushings 41 through which a plurality of multiple conductor cables, such as the one marked 42, pass. A piece of molding 43 is fastened to outboard end wall 35 of the control module box. The length of this molding section is equal to the length of the gap defined between parting lines or edges 25 and 26 in the fixed molding 24 which is identified in FIG. 1. The cross-sectional configuration of the piece of molding 43 in FIG. 2 and the front contour of the piece are identical to the cross-section of fixed molding 24 on the storage units in FIG. 1 since both moldings are plastic members extruded through the similar dies, not shown.

Figures 4, 5, 6, 7, 8:
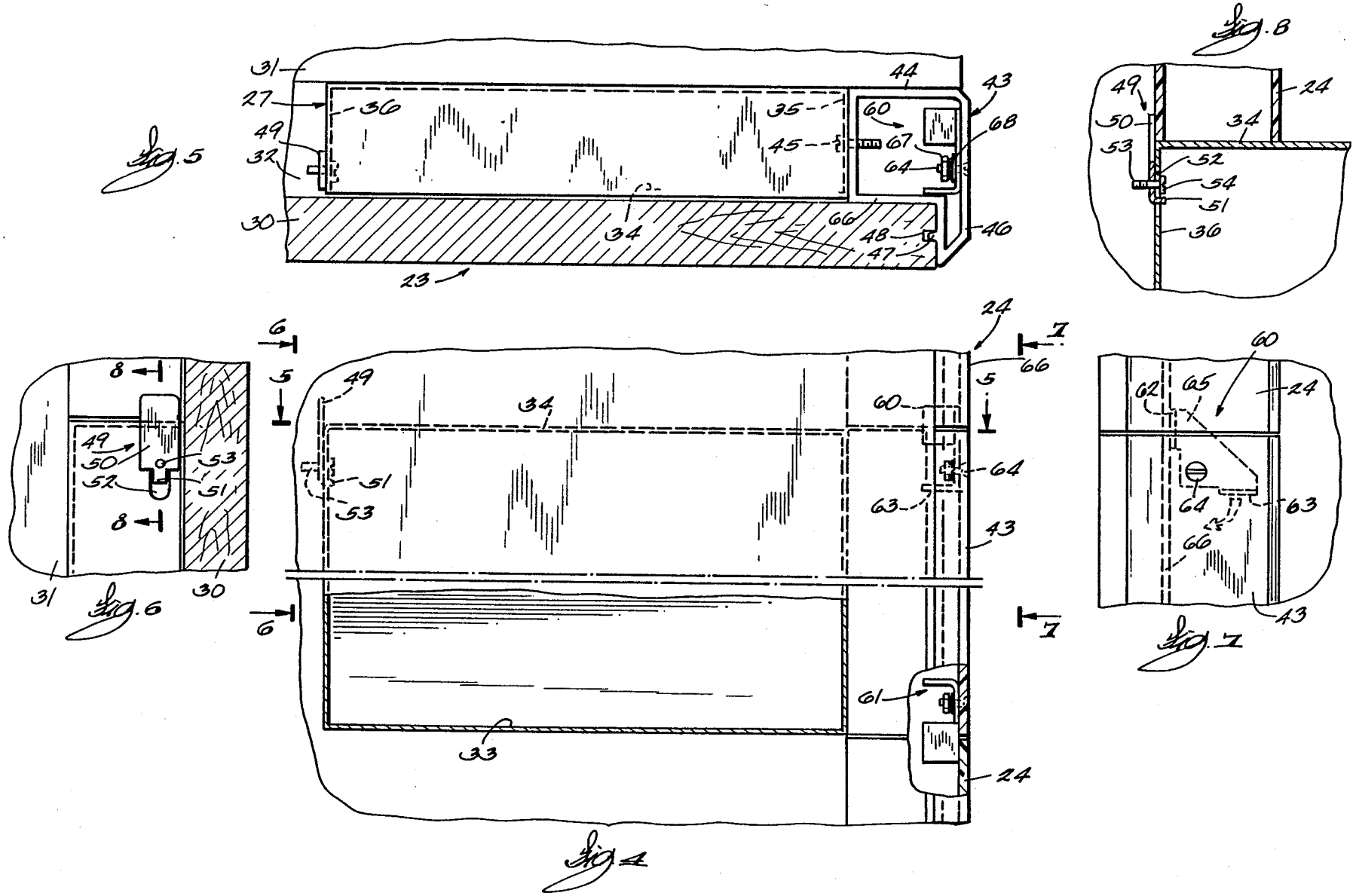
FIG. 4 shows a fragment of the end wall of a storage unit wherein the electrical control module is installed and where part of the module is shown in hidden lines and another part in section.
FIG. 5 is a transverse section of the end wall of a storage unit taken on a line corresponding with 5—5 in FIG. 4 and showing how the electrical control module appears from the top when it is installed in the end wall of a mobile storage unit.
FIG. 6 is a partial vertical section taken on the line 6—6 in FIG. 4 to show the means by which the control module is stopped or retained in the wall of a storage unit when the module is withdrawn sufficiently far for permitting maintenance and inspection of the module.
FIG. 7 is a fragmentary side elevational view taken along line 7—7 in FIG. 4 of a locking member which is one of two locking members used to lock the module in the end wall of a storage unit.
FIG. 8 is a fragmentary vertical sectional view of the module stop means taken on a line corresponding with 8—8 in FIG. 6.

Referring to FIG. 5, the section or piece of molding 43 is mounted to the side wall 35 of the control module box with two screws such as the one marked 45. If the box had no side wall 35 the molding piece could be fastened to tabs not shown, which are bent up from bottom 37. The extruded piece of molding 43 has a laterally extending hollow portion 46 formed integrally with it. This piece 43 overlays the end of vertical end wall panel 30 of the storage unit and is provided with a protuberance 47 which registers in a groove 48 and assures that the section 43 will appear to be flush with the contiguous molding 24 when viewed from any direction.

FIG. 2 shows the control module box 27 captured in the gap in fixed molding 24 and retracted from the space which is defined between the decorative vertical panel member 30 and structural member 31 which comprises the end of a bin or shelf or the like comprising a storage unit. In FIG. 2, one may see that there is a stop element 49 attached to side wall 36 of the control module box. Stop element 49 prevents complete inadvertent withdrawal of the control module from the space between vertical panels 30 and 31 which comprise the decorative end panel 23 of the storage units.

Stop element 49 is also illustrated in FIGS. 4, 5, 6 and 8 to which attention is now invited. Stop element 49 has a flat portion 50 which terminates at its lower end in a tang 51 in which there is a right angle bend. The tang extends through a narrow slot 52 in the side wall 36 of the box. As can be seen best in FIG. 8, there is a screw 53 which extends freely through slot 52 and is threaded into the flat area 50 of stop element 49. The head 54 of the screw 53 is wider than slot 52 so that when the screw is turned tightly into the stop member 50, the stop element is clamped tightly against the side wall 36 of the control module box 27.

When the control module is first installed in the space 32 between the upright members 30 and 31 comprising the end of a storage unit, screw 53 is loosened to allow the top end of the stop element 49 to drop down below the level of the upper end wall 34 of the control module box. This allows the module to fit through the gap between edges 25 and 26 in the molding 24 of the storage unit. When the box is pushed into the gap far enough to have the stop element 50 clear the inside edge of the molding 24, the stop element is lifted by engaging the tang 51 and, after that is done, screw 53 is tightened. Hence, as shown best in FIG. 2, stop element 49 is then situated in an interference relationship against the back of molding 24. At this time the bottom or lower end wall 33 of the control module box rests on the upper end of molding 24 so the module is supported like a drawer.

Figure 3:
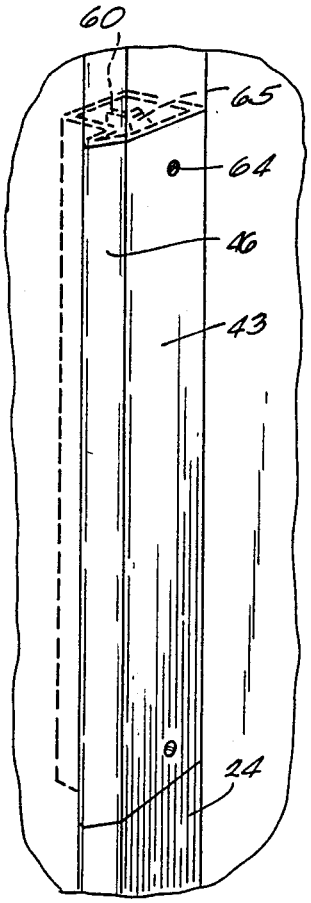
FIG. 3 shows in solid lines that part of the electrical control module which an observer sees when the module is inserted in operating position in the end wall of a storage unit.

Now to be discussed are the means for locking the control module 27 in the upright end 23 of the storage unit so as to keep the molding section 43 on the control module box flush with fixed molding 24 and to discourage unauthorized entry into the control module. The locking means are comprised of upper and lower locking levers 60 and 61, respectively. The profile of typical locking lever 60 is visible in dashed lines in FIG. 7 and a frontal view of it is visible in FIG. 5. As shown in FIG. 7, the locking member 60 is provided with two flat stop surfaces 62 and 63 which are at right angles to each other. The lever is pivotable on a pivot element in the form of a flat headed screw 64 which passes through a clearance hole in the contoured front face of the molding section 43 which is fastened to the control box. In FIG. 7, the module is locked. The lever 60 has been rotated to its counterclockwise limit by turning pivot screw 64 counterclockwise. This puts the upper triangular end 65 of the locking lever in interfering relationship with the back side of the front face 66 of the fixedly mounted molding 24. As is evident in FIG. 5, the pivot screw 64 with which the locking lever 60 is turned is provided with a nut 67 and there is a toothed washer 68 interposed between the nut and the body of the locking member 60. Consequently, when screw 64 is turned by engaging its socketed or slotted head with a tool such as a hexagon wrench or a screwdriver, neither of which is shown, the toothed washer 68 which bites into the locking lever causes the lever to rotate with the screw. FIG. 3 shows the locking lever triangular end portion 65 in its upstanding or interfering and locking position.

Although a preferred embodiment of the new withdrawable and concealable control module has been described in detail, such description is intended to be illustrative rather than limiting, for the invention may be variously embodied and is to be limited only by the interpretation of the claims which follow.

We claim:

1. In combination, a storage unit and an electrical control module, the storage unit comprising laterally spaced apart vertically extending end members and upper and lower structural members spanning between and joined with the end members, means including wheels supporting said unit for moving horizontally, and reversible electric motor means mounted on the unit and operatively connected to the wheels for propelling said unit bidirectionally, at least one upright end of the storage unit comprising laterally spaced apart members which have adjacent vertically extending edges, a vertically extending molding having a front face which has a predetermined contour and is fixed contiguous with said edges to conceal the space between said spaced apart members, said molding containing a vertically extending gap, said control module comprising box means and electric circuit means mounted on said box means, said control module being located in said gap in the molding and between said members, a piece of molding fastened to said box means, said piece having a front face which has the same contour as said fixed molding and has a length which fits into said gap with minimal clearance to provide for the contoured face of the molding on the control module and the fixed molding being flush with said module inserted into the gap, and locking means mounted to said module for releasably locking said module in said gap.

2. The apparatus according to claim 1 wherein:

said box of the control module having a bottom, opposite end walls and opposite side walls joined with the bottom and an opening which is nominally the top, the distance between said end walls and the length of at least one side wall of the box being substantially equal to the length of said gap and said piece of molding being fastened to said one side wall.

3. The apparatus according to any one of claims 1 or 2 wherein said piece of molding and said fixed molding are hollow lengthwise to provide a free space behind said front face, said locking means comprising a locking lever member arranged in said free space behind said front face of the piece and including a pivot element having one end fastened to said locking lever member and extending through said front face of the piece to present .the other end of the pivot element to the front of the front face to provide for said pivot element being engageable for being rotatable in one direction to dispose the locking lever member in locking position behind said front face and rotatable in the opposite direction to dispose said locking lever member in interfering relation behind the front face of said fixed molding.

4. The apparatus according to claim 3 wherein said other end of said pivot element is configured for being engaged by a tool to rotate said locking member.

5. The apparatus according to any one of claims 1 or 2 including:

a stop element on said support member of the control module at a side of said module which is remote from the side on which said piece of molding is fastened and is the first side to enter said gap when said module is being inserted in the gap, means for holding said stop element in retracted position to allow said control module to fit through said gap in said fixed molding and for alternately holding said element in advanced position after said module is in the gap such that said stop element protrudes from said module to prevent unintentional withdrawal of said module from said gap.

6. The apparatus according to claim 5 wherein said stop element is a flat metal plate having a tang extending integrally from the plate in a direction substantially perpendicular to the plate, said support member having an elongated slot into which said tang extends, a screw extending through said slot, said screw having a head wider than the slot and disposed on one side of the slot and having an end threaded into said plate.

7. The apparatus according to any one of claims 1 or 2 wherein:

said molding which is fixed on said storage unit and said piece of molding which is fixed on said module are extruded of plastic material and are hollow lengthwise, said fixed molding and piece of molding having similar cross-sectional configurations.

* * * * *